US009010345B2

(12) United States Patent
Mitchell et al.

(10) Patent No.: US 9,010,345 B2
(45) Date of Patent: Apr. 21, 2015

(54) DISHWASHER SPRAY ARM ASSEMBLY

(75) Inventors: Alan Joseph Mitchell, Louisville, KY (US); Errin Whitney Gnadinger, Louisville, KY (US); Ronald Scott Tarr, Louisville, KY (US); Ramasamy Thiyagarajan, Louisville, KY (US)

(73) Assignee: General Electric Company, Schenectady, NY (US)

( * ) Notice: Subject to any disclaimer, the term of this patent is extended or adjusted under 35 U.S.C. 154(b) by 936 days.

(21) Appl. No.: 13/166,488

(22) Filed: Jun. 22, 2011

(65) Prior Publication Data

US 2012/0325277 A1 Dec. 27, 2012

(51) Int. Cl.
*A47L 15/42* (2006.01)
*A47L 15/23* (2006.01)

(52) U.S. Cl.
CPC ..... *A47L 15/4282* (2013.01); *A47L 15/23* (2013.01)

(58) Field of Classification Search
CPC ..... A47L 15/08; A47L 15/10; A47L 15/0031; A47L 15/0047; A47L 15/42; A47L 15/4223; A47L 15/4278; A47L 15/428; A47L 15/4289; A47L 15/14; A47L 15/18; A47L 15/22; A47L 15/23; A47L 15/4221; A47L 15/4248; A47L 2501/03; A47L 2501/02; B05B 1/02; B05B 1/14; B05B 1/20; B05B 1/26; B05B 1/34; B05B 1/30; B05B 3/00; B05B 3/008; B05B 3/02
USPC ..... 134/198, 18, 25.2, 56 D, 178, 172
See application file for complete search history.

(56) References Cited

U.S. PATENT DOCUMENTS 2,548,100 A 4/1951 Culligan et al.
2,669,999 A * 2/1954 McMillan ..... 134/103.1
5,263,504 A * 11/1993 Bailey et al. ..... 134/176

FOREIGN PATENT DOCUMENTS

WO WO-00/30759 A1 * 6/2000 ..... B05B 7/04

* cited by examiner

*Primary Examiner* — Michael Barr
*Assistant Examiner* — Irina Graf
(74) *Attorney, Agent, or Firm* — Global Patent Operation; Douglas D. Zhang

(57) ABSTRACT

A spray arm assembly for a dishwasher system is disclosed. The spray arm assembly includes a spray arm which has an internal chamber, a liquid inlet in flow communication with the internal chamber to supply the internal chamber with liquid from a source of liquid, an outlet passageway in flow communication with the internal chamber for discharging liquid from the internal chamber, an air inlet in flow communication with the outlet passageway, and a region adjacent the air inlet and defining part of the outlet passageway. The region is configured to create a venturi effect at the air inlet when the liquid passes through the region so that air is drawn into the outlet passageway from the air inlet and a mixture of air and liquid is discharged from the outlet passageway. A dishwasher system incorporating such a spray arm assembly is also disclosed.

20 Claims, 6 Drawing Sheets

DISHWASHER SPRAY ARM ASSEMBLY

BACKGROUND OF THE INVENTION

The subject matter disclosed herein relates generally to appliances and more particularly, to spray arm assemblies for dishwasher systems and dishwasher systems incorporating such spray arm assemblies.

A dishwasher system is a mechanical device for cleaning dishwasher items such as dishes, utensils and other items. Some known dishwasher systems include a main pump assembly and a drain pump assembly for circulating and draining washing fluid within a wash chamber located in a cabinet housing. The main pump assembly feeds washing fluid to various spray arm assemblies for generating washing sprays or jets on the dishwasher items loaded into one or more dishwasher racks disposed in the wash chamber. Washing fluid sprayed onto the dishwasher items is collected in a sump located in a lower portion of the wash chamber, and washing fluid entering the sump is filtered through one or more coarse filters to remove soil and sediment from the washing fluid. Some dishwasher systems include upper and/or mid-level spray arms and lower spray arms. In operation, washing fluid is simultaneously supplied to both the upper and/or mid-level spray arms and to the lower spray arm.

The combination of mechanical energy and chemical action removes food particles from the dishwasher items. A conventional spray nozzle creates a solid washing fluid stream, and the spray nozzle contains an orifice or outlet that acts to increase the velocity of the washing fluid stream by a providing a restriction. However, the diameter of the spray nozzle's outlet is limited because food particles may lodge inside the outlet if the diameter is too small, which may result in clogging. Also, the diameter of the outlet cannot be too large because if the diameter is too large, the velocity of the washing fluid stream will not provide enough mechanical energy to effectively remove food particles from the dishwasher items. Further, if the diameter is too large, the dishwasher system will consume more water. A dishwasher system that uses less water is more advantageous.

Improving the cleaning performance and energy consumption of dishwasher systems could amount to a significant energy savings because many dishwasher systems are currently being used.

BRIEF DESCRIPTION OF THE INVENTION

As described herein, the exemplary embodiments of the present invention overcome one or more disadvantages known in the art.

According to one aspect of the invention, a spray arm assembly for a dishwasher system is provided. The spray arm assembly comprises a spray arm. The spray arm has an internal chamber, a liquid inlet in flow communication with the internal chamber to supply the internal chamber with liquid from a source of liquid, an outlet passageway in flow communication with the internal chamber for discharging liquid from the internal chamber, an air inlet in flow communication with the outlet passageway, and a region adjacent the air inlet and defining part of the outlet passageway. The region is configured to create a venturi effect at the air inlet when the liquid passes through the region so that air is drawn into the outlet passageway from the air inlet and a mixture of air and liquid is discharged from the outlet passageway.

According to another aspect of the invention, a dishwasher system comprises a cabinet and a spray arm assembly rotatably disposed within the cabinet. The spray arm assembly comprises a spray arm having an internal chamber, a liquid inlet in flow communication with the internal chamber to supply the internal chamber with liquid from a source of liquid, an outlet passageway in flow communication with the internal chamber for discharging liquid from the internal chamber, an air inlet in flow communication with the outlet passageway, and an region adjacent the air inlet and defining part of the outlet passageway. The region is configured to create a venturi effect at the air inlet when the liquid passes through the region so that air is drawn into the outlet passageway from the air inlet and a mixture of air and liquid is discharged from the outlet passageway.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

DETAILED DESCRIPTION OF THE EXEMPLARY EMBODIMENTS OF THE INVENTION

The present embodiments provide for an improved wash performance of a dishwasher system. As previously indicated, the diameter of a spray nozzle's outlet that discharges washing fluid from a spray arm of the dishwasher system is limited because food particles may lodge inside the outlet of the spray nozzle if the diameter is too small, which may result in clogging. Conversely, the diameter of the outlet cannot be too large because if the diameter is too large, the velocity of the washing fluid that is discharged from the nozzle will not provide enough mechanical energy to effectively remove food particles from dishwasher items. As discussed hereinafter, in exemplary embodiments, spray arm assemblies that allow for a high velocity washing fluid stream are disclosed.

Figure 1:
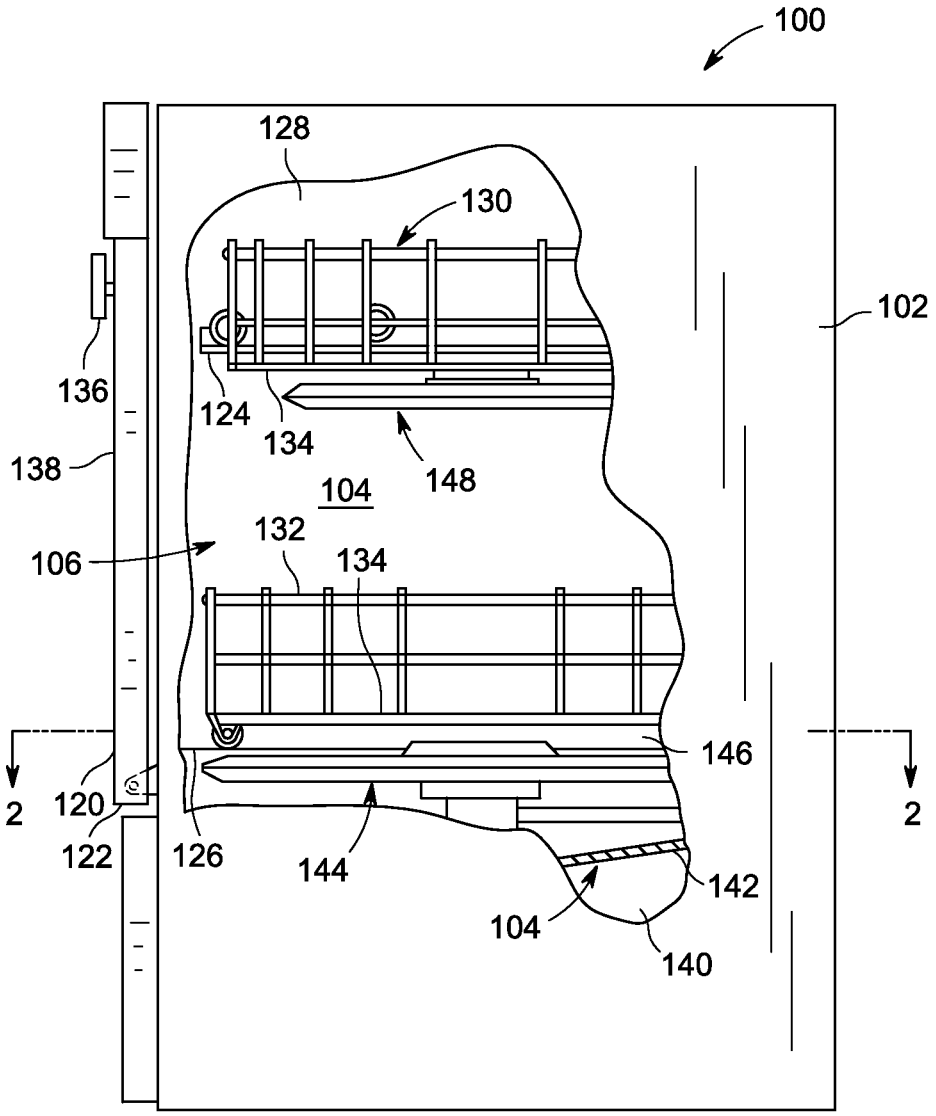
FIG. 1 is a side elevation view of an exemplary dishwasher system partially broken away.

FIG. 1 is a side elevation view of an exemplary dishwasher system 100 partially broken away, and in which the present embodiments of the spray arm assembly may be implemented. It is contemplated, however, that the present embodiments may be practiced in other types of dishwasher systems other than just dishwasher system 100 described and illustrated herein. Accordingly, the following description is for illustrative purposes only, and the present embodiments are not limited to use in a particular type of dishwasher system, such as dishwasher system 100.

Dishwasher system 100 includes a cabinet 102 having a tub 104 therein and forming a wash chamber 106. Tub 104 includes a front opening (not shown in FIG. 1) and a door 120 hinged at its bottom 122 for movement between a normally closed vertical position (shown in FIG. 1) wherein the wash chamber 106 is sealed shut for washing operation, and a substantially horizontal open position (not shown) for loading and unloading of dishwasher contents.

Upper and lower guide rails 124, 126 are mounted on tub side walls 128 and accommodate upper and lower roller-equipped racks 130, 132, respectively. Each of upper and lower racks 130, 132 is fabricated from known materials into lattice structures including a plurality of elongate members 134, and each rack 130, 132 is adapted for movement between an extended loading position (not shown) in which at least a portion of the rack is positioned outside wash chamber 106, and a retracted position (shown in FIG. 1) in which the rack is located inside wash chamber 106. Conventionally, a utensil basket (not shown) is removably attached to lower rack 132 for placement of utensils, and the like that are too small to be accommodated by upper and lower racks 130, 132.

A control input selector 136 is provided, for example, at a convenient location on an outer face 138 of door 120 and is coupled to known control circuitry (not shown) and control mechanisms (not shown) for operating a fluid circulation assembly (not shown in FIG. 1) for circulating water and dishwasher fluid in tub 104. The fluid circulation assembly is located in a machinery compartment 140 located below a bottom sump portion 142 of tub 104, and its construction and operation is explained in detail below.

A lower spray arm assembly 144 is rotatably mounted within a lower region 146 of wash chamber 106 and above tub sump portion 142 so as to rotate in relatively close proximity to lower rack 132. A mid-level spray arm assembly 148 is located in an upper region of wash chamber 106 in close proximity to upper rack 130 and at a sufficient height above lower rack 132 to accommodate items such as a dish or platter (not shown) that is expected to be placed in lower rack 132. In a further embodiment, an upper spray arm assembly (not shown) is located above upper rack 130 at a sufficient height to accommodate a tallest item expected to be placed in upper rack 130, such as a glass (not shown) of a selected height.

Lower and mid-level spray arm assemblies 144, 148 and the upper spray arm assembly are fed by the fluid circulation assembly, and each spray arm assembly includes an arrangement of discharge ports, orifices, or outlets for directing washing liquid onto dishes located in upper and lower racks 130, 132, respectively. The arrangement of the discharge ports in at least lower spray arm assembly 144 results in a rotational force as washing fluid flows through the discharge outlet. The resultant rotation of lower spray arm assembly 144 provides coverage of dishes and other dishwasher contents with a washing spray. In various alternative embodiments, mid-level spray arm assembly 148 and/or the upper spray arm assembly are rotatable mounted and configured to generate a swirling spray pattern above and below upper rack 130 when the fluid circulation assembly is activated.

Figure 2:
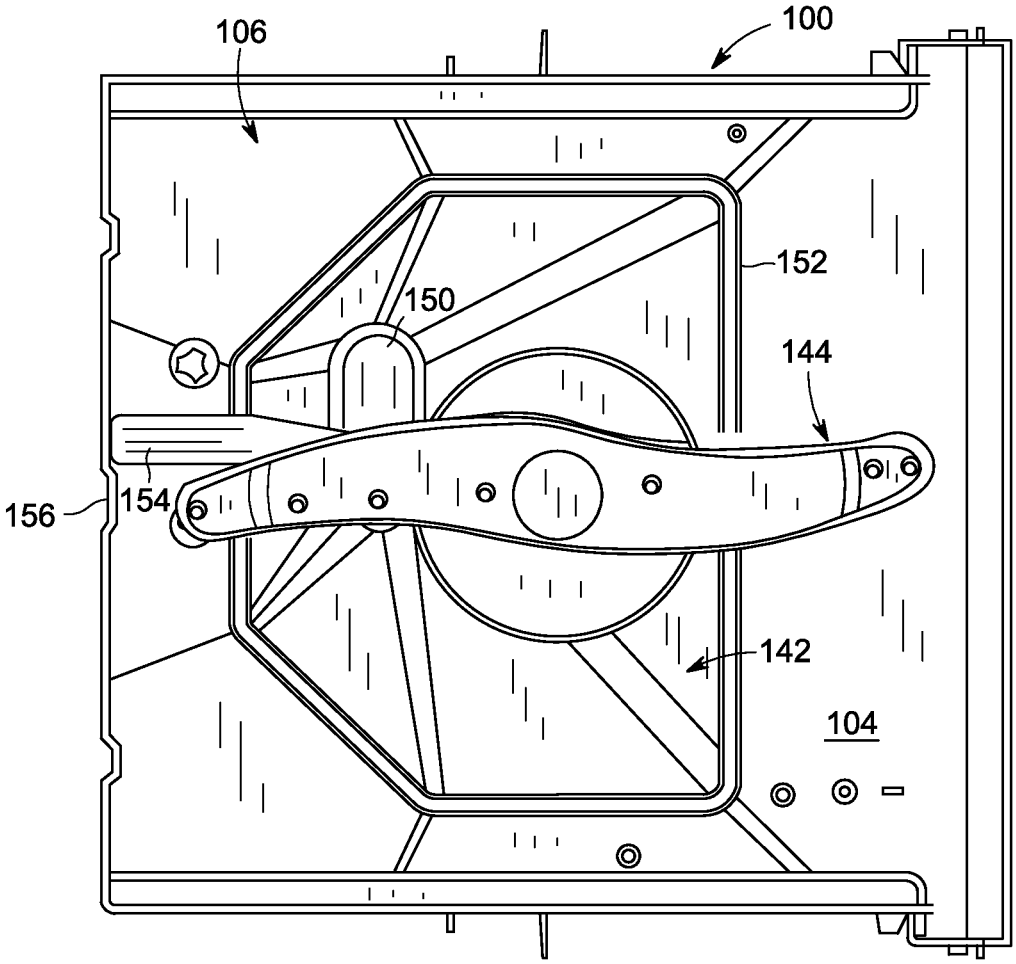
FIG. 2 is a top plan view of the dishwasher system of FIG. 1 along line 2-2.

FIG. 2 is a top plan view of the dishwasher system 100 just above lower spray arm assembly 144. Tub 104 is generally downwardly sloped beneath lower spray arm assembly 144 toward tub sump portion 142, and tub sump portion is generally downwardly sloped toward a sump 150 in flow communication with the fluid circulation assembly (not shown in FIG. 2). Tub sump portion 142 includes a six-sided outer perimeter 152. Lower spray arm assembly 144 is substantially centered within tub 104 and wash chamber 106, off-centered with respect to tub sump portion 142, and positioned above tub 104 and tub sump portion 142 to facilitate free rotation of spray arm 144.

Tub 104 and tub sump portion 142 are downwardly sloped toward sump 150 so that washing fluid sprayed from lower spray arm assembly 144, mid-level spray arm assembly 148 (shown in FIG. 1) and the upper spray arm assembly (not shown) is collected in tub sump portion 142 and directed toward sump 150 for filtering and re-circulation during a dishwasher system wash cycle. In addition, a conduit 154 extends beneath lower spray arm assembly 144 and is in flow communication with the fluid circulation assembly. Conduit 154 extends to a back wall 156 of wash chamber 106, and upward along back wall 156 for feeding wash fluid to mid-level spray arm assembly 148 and the upper spray arm assembly.

FIGS. 3*a*, 3*b*, 4*a*, 4*b*, 5 and 6 are cross sectional schematic views of exemplary spray arm assemblies 144, 444, 544, 644 for use with a dishwasher system, such as, but not limited to the dishwasher system 100 of FIG. 1. As shown in FIGS. 3*a*, 3*b*, 4*a*, 4*b*, 5 and 6, the exemplary spray arm assembly 144, 444, 544, 644 comprises a spray arm 300, 400, 500, 600. The spray arm 300, 400, 500, 600 has an internal chamber 310, 410, 510, 610, a liquid inlet 320, 420, 520, 620, one or more outlet passageways 330, 430, 530, 630, one or more air inlets 340, 440, 540, 640, and one or more areas or regions 335, 435, 535, 635 adjacent to a respective one of the one or more air inlets 340, 440, 540, 640.

Figure 3A:
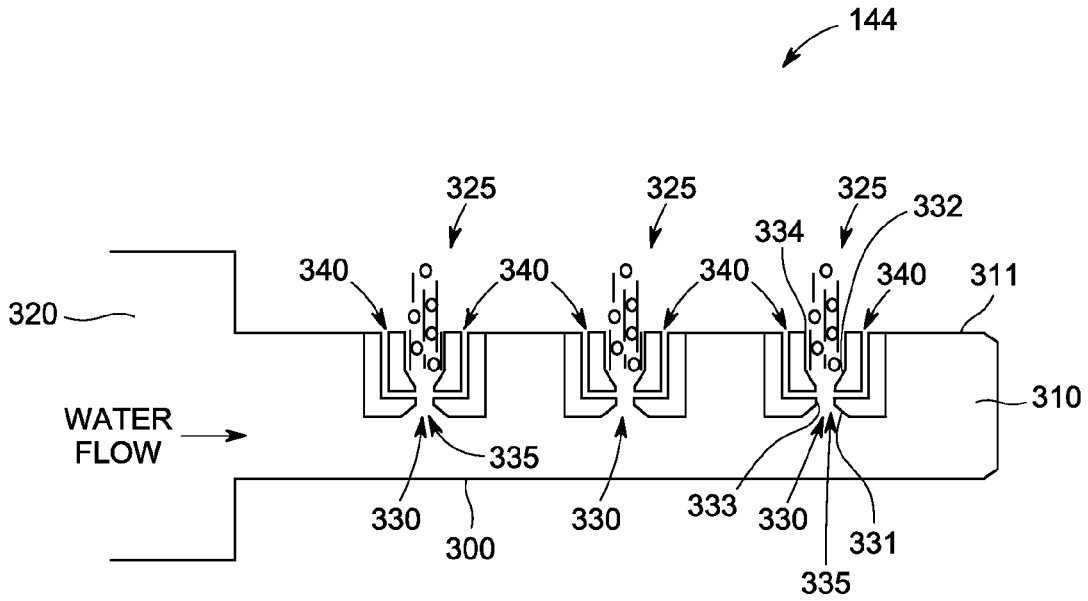
FIG. 3*a* is a partial, cross sectional, schematic view of an exemplary spray arm assembly for use with the dishwasher system shown in FIG. 1.
Figure 3B:
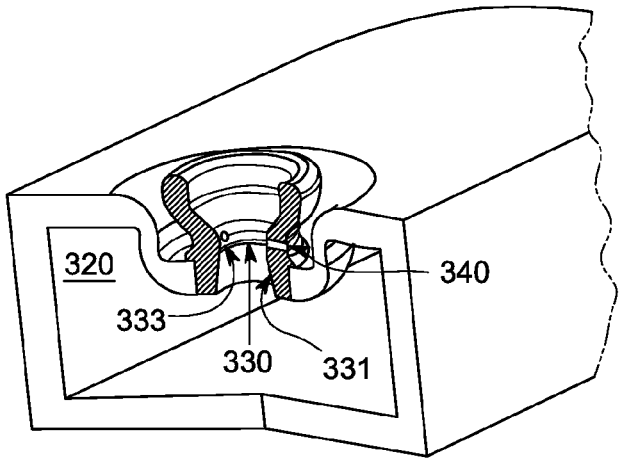
FIG. 3*b* is an enlarged, partial cut away, exemplary cross sectional view of the exemplary spray arm assembly of FIG. 3*a;*

FIG. 3*a* is a partial, cross sectional, schematic view of an exemplary spray arm assembly 144 for use with a dishwasher system, such as, but not limited to, the dishwasher system 100 of FIG. 1. FIG. 3*b* is an enlarged, partial cut away, exemplary cross sectional view of the exemplary spray arm assembly of FIG. 3*a*. As shown in FIGS. 3*a* and 3*b*, the liquid inlet 320 is in flow communication with the internal chamber 310 to supply the internal chamber 310 with liquid from a source of liquid such as a municipal water supply. The liquid travels through the liquid inlet 320 to enter the internal chamber 310 and exits the internal chamber 310 through the outlet passageways 330. In other words, each outlet passageway 330 is in flow communication with the internal chamber 310, and discharges liquid from the internal chamber 310.

Each outlet passage 330 is defined by the main body of a respective aspirator-type nozzle 325 which is supported by a wall 311 of the spray arm assembly 144 that defines the internal chamber 310. Preferably the exterior end of nozzle 325 is flush with an exterior surface of the wall 311. The outlet passageway 330 has an inner, converging section 331, an outer, diverging section 332, a transitional section 333 that is between the converging section 331 and the diverging section 332, and an outermost, main section 334 that is downstream of the diverging section 332 and has a substantially constant diameter. The main body of the nozzle 325 also defines therein the air inlet 340 that starts from an exterior surface of the main body of the nozzle 325 and terminates at or adjacent to the transitional section 333. As shown in FIGS. 3*a* and 3*b*, the air inlet 340 provides an air path from outside of the spray arm 300 to the venturi tube 325. As shown in FIG. 3*b*, the shape of the air inlet 340 may be curved. Alternatively, the shape of the air inlet 340 may be relatively straight. For example, the air inlet may be a circular hole; however, it is not limited to such a shape. The region 335 that is defined by the interior wall surfaces of converging section 331 and the transitional section 333 is shaped or configured to create a venturi effect at the air inlet 340 so that when the liquid passes through the region 335, a pressure below the atmospheric pressure is created at the air inlet 340 which draws air into the outlet passageway 330 from the air inlet 340 so that a mixture of air and liquid is discharged from the outlet passageway 330. To provide the desired venturi effect, the cross section area of the air inlet 340 is preferably smaller than the cross section area of the smallest diameter portion of the transitional section 333. A ratio of the cross section area of the transitional section 333 to the cross section area of the air inlet 340 on the order of 4 to 1 should provide satisfactory results.

The added air increases the spray distance of the washing fluid coming out of the nozzle 325 without physically changing the diameter of the main section 334 of the outlet passageway 330. As the actual diameter of the main section 334 does not change, the tendency for clogging is not increased. Embodiments of the present invention provide for an improved cleaning performance of a dishwasher system. Mixing air with the liquid provides for an increased spray distance, as compared to conventional designs. As a result, to achieve the same spray distance, conventional designs need more energy.

Figure 4A:
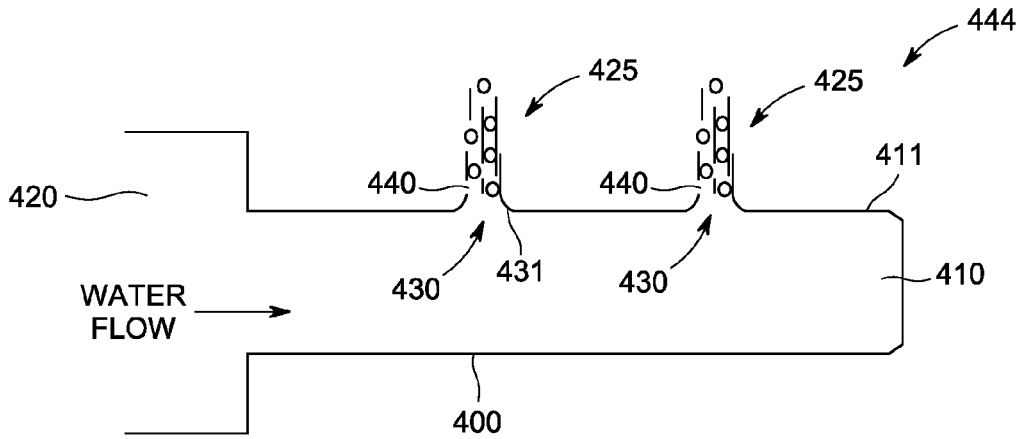
FIG. 4*a* is a partial, cross sectional schematic view of another exemplary spray arm assembly for use with the dishwasher system shown in FIG. 1.
Figure 4B:
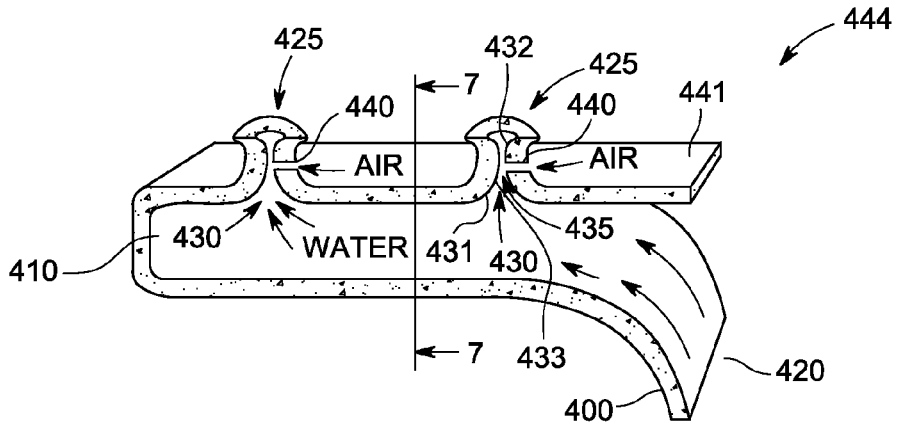
FIG. 4*b* is an enlarged, partial cut away, cross sectional view of the exemplary spray arm assembly of FIG. 4*a;*

FIG. 4*a* is a cross sectional schematic view of an exemplary spray arm assembly 444 for use with a dishwasher system, such as, but not limited to the dishwasher system 100 of FIG. 1. FIG. 4*b* is an enlarged, partial cut away, cross sectional view of the exemplary spray arm assembly 444 of FIG. 4*a*. As shown in FIGS. 4*a* and 4*b*, the liquid inlet 420 is in flow communication with the internal chamber 410 to supply the internal chamber 410 with liquid from a source of liquid. The liquid travels through the liquid inlet 420 to enter the internal chamber 410 and exits the internal chamber 410 through the outlet passageways 430.

Each outlet passageway 430 is defined by a main body of a respective nozzle or venturi tube 425 which is preferably integrally formed with a wall 411 of the spray arm assembly 444 that defines the internal chamber 410. In the embodiment shown, the nozzle 425 extends outward from the exterior surface of the wall 411. In the embodiment shown, the outlet passageway 430 has an inner, converging section 431, an outer, main, diverging section 432, and a transitional section 433 that is between the converging section 431 and the diverging section 432. In an alternate embodiment, the outlet passageway 430 may be straight. The main body of the nozzle 425 also defines therein the air inlet 440 that starts from an exterior surface of the main body of the nozzle 425 and terminates at or adjacent to the transitional section 433. The cross section of the air inlet 440 is preferably smaller than that of the smallest diameter portion of the transitional section 433. The ratio of the cross section of the transitional section 333 to cross section of the air inlet 340 is approximately 4 to 1. The region 435 that is defined by the interior wall surface of converging section 431 and the transitional section 433 is configured or shaped to create a venturi effect at the air inlet 440 so that when liquid passes through the region 435, a pressure below the atmospheric pressure is created at the air inlet 440 in order to suck air into the outlet passageway 430 from the air inlet 440 so that a mixture of air and liquid is discharged from the outlet passageway 430. In one embodiment, as shown in FIG. 4*b*, the air inlet 440 is perpendicular to the outlet passageway 430. Alternatively, the air inlet 440 may be parallel, as shown and described in FIGS. 6*a* and 6*b*, or inclined at an angle of greater than 0 degrees with the outlet passageway 430.

Figure 5:
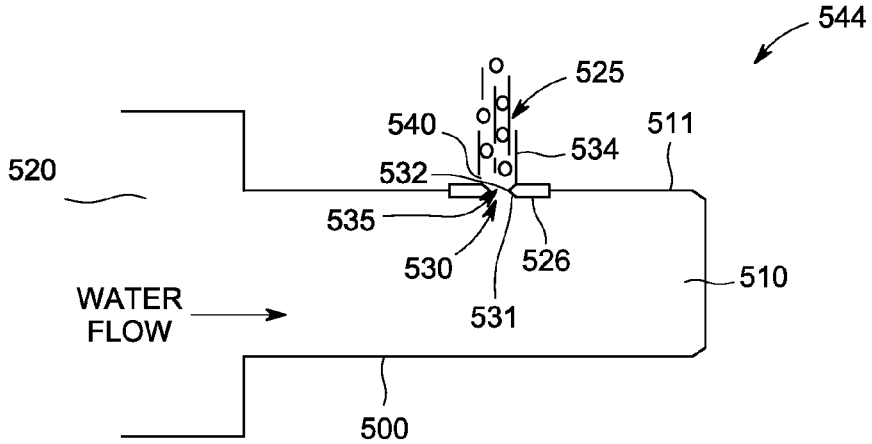
FIG. 5 is a partial, cross sectional schematic view of yet another exemplary spray arm assembly for use with the dishwasher system shown in FIG. 1.

FIG. 5 is a cross sectional schematic view of an exemplary spray arm assembly 544 for use, for example, with the dishwasher system 100 of FIG. 1. This embodiment 544 is a variation of the embodiment shown in FIG. 3*a*, and therefore similar reference numerals have been used to designate components with similar functions.

As shown in FIG. 5, the nozzle 525 has a knife-edge member 526 that is supported by the wall 511. The knife-edge member 526 defines a knife-edge orifice that has an inner, converging section 531 and an outer, diverging section 532 which extends outward from the converging section 531. The air inlet 540 is formed in the main section 534 of the outlet passageway 530 and is disposed adjacent to the exterior surface of the knife-edge member 526. The lower end of the air inlet 540 is located closely to the exterior surface of the knife-edge member 526. For example, the distance between the lower end of the air inlet 540 and the exterior surface of the knife-edge member 526 could be 0. The area 535 that defines the knife-edge orifice is configured or shaped to create a venturi effect at the air inlet 540 so that when liquid passes through the knife-edge orifice, a pressure below the atmospheric pressure is created at the air inlet 540 in order to suck air into the outlet passageway 530 from the air inlet 540 so that a mixture of air and liquid is discharged from the outlet passageway 530.

Figure 6A:
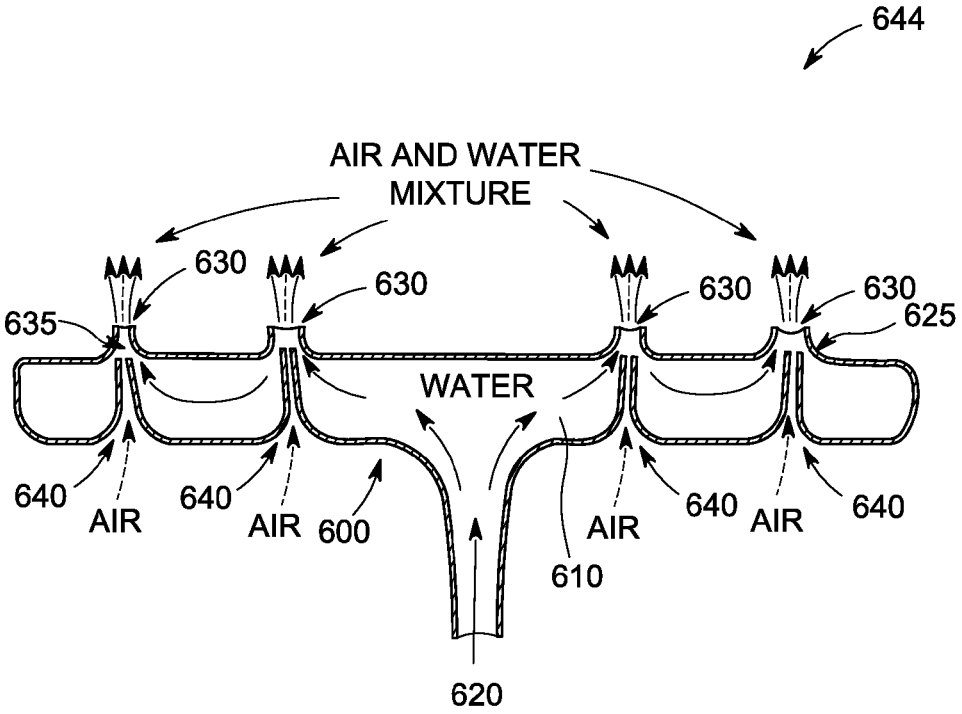
FIG. 6*a* is a cross sectional schematic view of an exemplary spray arm assembly for use with the dishwasher system shown in FIG. 1.
Figure 6B:
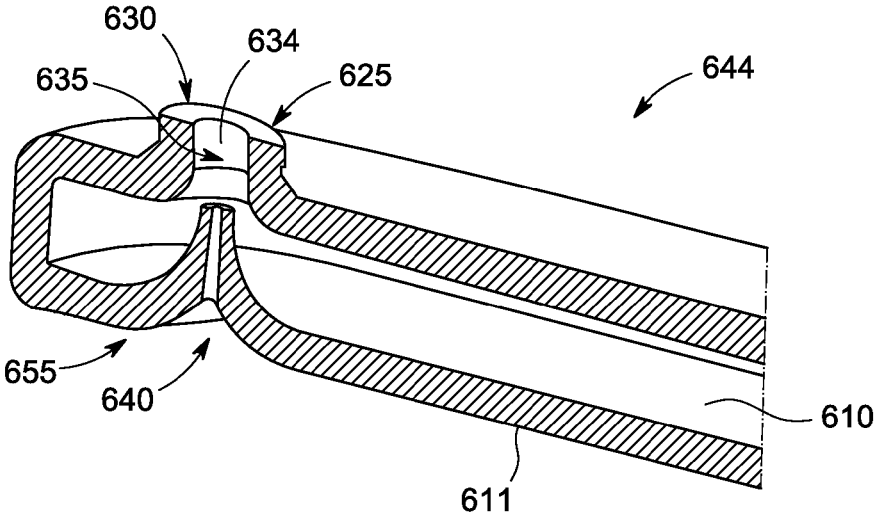
FIG. 6*b* is an enlarged, partial cut away, cross sectional view of the exemplary spray arm assembly of FIG. 6*a*.

FIG. 6*a* is a cross sectional schematic view of an exemplary spray arm assembly 644 for use with a dishwasher system, such as, but not limited to, the dishwasher system 100 of FIG. 1. FIG. 6*b* is an enlarged, partial cut away, cross sectional view of the exemplary spray arm assembly 644 of FIG. 6*a*. This embodiment 544 is a variation of the embodiment shown in FIGS. 4*a* and 4*b*, and therefore similar reference numerals have been used to designate components with similar functions.

One of the differences between the two embodiments is that the main section 634 of each outlet passageway 630 in FIG. 6*b* has a substantially constant diameter/cross section. In addition, the respective air inlet 640 is not formed or defined by the nozzle 625. Rather, it is defined by an air nozzle 655 which is preferably integrally formed with the wall 611 of the spray arm assembly 644. The air nozzle 655 is spaced apart from the outlet passageway 630, but the air nozzle 655 is located closely to the outlet passageway 630. In one embodiment, the air nozzle 655 is located closely to the outlet passageway 630, where there is a low pressure zone region. The air nozzle 655 may be below, flush with, or above the plane of the bottom wall of the outlet passageway 630, as a pressure below the atmospheric pressure is created at the air inlet 640 in order to suck air into the outlet passageway 630 from the air inlet 640 so that a mixture of air and liquid is discharged from the outlet passageway 630. Preferably, the air inlet 640 is aligned with the outlet passageway 630 coaxially, and has a diameter/cross section which is smaller than that of the outlet passageway 630. The area 635 remains pretty much the same compared with the area in the embodiment shown in FIGS. 4*a* and 4*b*.

Figure 7C:
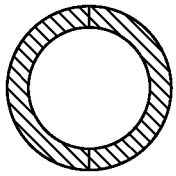
FIGS. 7*b*-7*e* show some exemplarily different shaped cross sections of the spray arm.
Figure 7B:
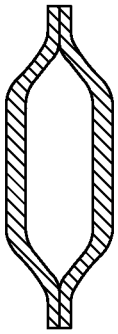
Figure 7E:
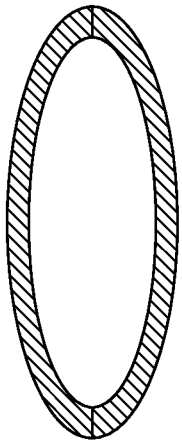
Figure 7A:
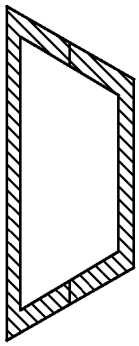
FIG. 7*a* is a cross sectional view of the spray arm assembly of FIG. 4*b* along line 7-7.
Figure 7D:
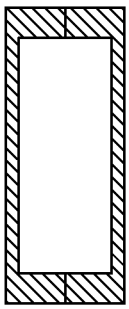

FIG. 7*a* is cross sectional view of the spray arm assembly 444 of FIG. 4*b* cut along line 7-7. FIGS. 7*b*-7*e* show that the cross section of the spray arm may be of different shapes.

More specifically, as shown in FIG. 7*a*, the cross section of the spray arm 400 may be in the shape of a trapezoid, with the upper portion being wider than the lower portion. The cross section of the spray arm 400, however, may be in the shape of an oblong with pinched sides (FIG. 7*b*), of a circular (FIG. 7*c*), of a rectangular where the upper and lower portions have a longer length than the sides (FIG. 7*d*), or of an oblong or elliptical (FIG. 7*e*), for example.

In one embodiment, each outlet passageway has a diameter in a range from about 0.125 inches to about 0.375 inches. In one embodiment, each air inlet has a diameter in a range from about 0.03 inches to about 0.1 inches.

In one embodiment, a mixture of air and liquid that is discharged from the outlet passageway has a pressure of about 4 psi and a flow rate in the range from about 0.65 gpm to about 0.85 gpm. When the mixture of air and liquid that is discharged from the outlet passageway has a pressure of about 4 psi, the mixture of air and liquid that is discharged from the outlet is sprayed to a height in the range from about 8 inches to about 20 inches. In a conventional design, where only liquid is discharged from the outlet at 4 psi, the flow rate is in the range from 0.70 gpm to 0.95 gpm, and the liquid that is discharged from the outlet is sprayed to a height in the range from 4 inches to 9 inches. Thus, embodiments of the present invention provide for less water usage than conventional designs.

In an alternate embodiment, a mixture of air and liquid that is discharged from the outlet passageway has a pressure of about 7 psi and a flow rate in the range from about 0.6 gpm to about 1.0 gpm. When the mixture of air and liquid that is discharged from the outlet passageway has a pressure of about 7 psi, the mixture of air and liquid that is discharged from the outlet is sprayed to a height in the range from about 6 inches to about 28 inches. In a conventional design, where only liquid is discharged from the outlet at 7 psi, the flow rate is in the range from 0.60 gpm to 1.10 gpm, and the liquid that is discharged from the outlet is sprayed to a height in the range from 3 inches to 12 inches. Embodiments of the present invention, which provide for the mixture of air to the liquid, allow for an increased spray height or distance over conventional designs with the same pressure. This provides for a larger spray height or distance and better spray coverage over conventional designs.

Thus, while there has been shown and described and pointed out fundamental novel features of the invention as applied to exemplary embodiments thereof, it will be understood that various omissions and substitutions and changes in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. Furthermore, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A spray arm assembly for a dishwasher system, the spray arm assembly comprising:

a spray arm having:

an internal chamber, a liquid inlet in flow communication with the internal chamber to supply the internal chamber with liquid from a source of liquid, a plurality of outlet passageways in flow communication with the internal chamber for discharging liquid from the internal chamber, a plurality of air inlets in flow communication with respective ones of the outlet passageways, and a region adjacent a given one of the air inlets and defining a part of a corresponding given one of the outlet passageways, wherein the region is configured to create a venturi effect at the given air inlet when the liquid passes through the region so that air is drawn into the given outlet passageway from the given air inlet and a mixture of air and liquid is discharged from the given outlet passageway, wherein the given outlet passageway comprises a converging section, a diverging section and a transitional section between the converging section and the diverging section, and wherein the given air inlet is in flow communication with the transitional section of the given outlet passageway and a chamber external to the spray arm.

2. The spray arm assembly of claim 1, wherein the given air inlet is defined by an air nozzle which is spaced apart from the given outlet passageway.

3. The spray arm assembly of claim 2, wherein the given air inlet is aligned with the given outlet passageway coaxially.

4. The spray arm assembly of claim 1, wherein the given outlet passageway is defined by an aspirator-type nozzle, a venturi tube or a nozzle with a knife-edge member.

5. The spray arm assembly of claim 1, wherein the given outlet passageway has a diameter in a range from about 0.125 inches to about 0.375 inches.

6. The spray arm assembly of claim 1, wherein the given air inlet has a diameter in a range from about 0.03 inches to about 0.1 inch.

7. The spray arm assembly of claim 1, wherein the mixture of air and liquid is to be discharged from the given outlet passageway at a pressure of about 4 pounds per square inch (psi) and a flow rate in a range from about 0.65 gallons per minute (gpm) to about 0.85 gpm.

8. The spray arm assembly of claim 7, wherein the mixture of air and liquid is to be discharged from the given outlet passageway and sprayed to a height in a range from about 8 inches to about 20 inches.

9. The spray arm assembly of claim 1, wherein the mixture of air and liquid is to be discharged from the given outlet passageway at a pressure of about 7 pounds per square inch (psi)and a flow rate in a range from about 0.6 gallons per minute (gpm) to about 1.0 gpm.

10. The spray arm assembly of claim 9, wherein the mixture of air and liquid is to be discharged from the given outlet passageway and sprayed to a height in a range from about 6 inches to about 28 inches.

11. A dishwasher system comprising:

a cabinet; and a spray arm assembly rotatably disposed within the cabinet, the spray arm assembly comprising:

a spray arm having an internal chamber, a liquid inlet in flow communication with the internal chamber to supply the internal chamber with liquid from a source of liquid, a plurality of outlet passageways in flow communication with the internal chamber for discharging liquid from the internal chamber, a plurality of air inlets in flow communication with respective ones of the outlet passageways, and a region adjacent a given one of the air inlets and defining a part of a corresponding given one of the outlet passageways, wherein the region is configured to create a venturi effect at the given air inlet when the liquid passes through the region so that air is drawn into the given outlet passageway from the given air inlet and a mixture of air and liquid is discharged from the given outlet passageway, wherein the given outlet passageway comprises a converging section, a diverging section and a transitional section between the converging section and the diverging section, and wherein the given air inlet is in flow communication with the transitional section of the given outlet passageway and a chamber external to the spray arm.

12. The dishwasher system of claim 11, wherein the given air inlet is defined by an air nozzle which is spaced apart from the given outlet passageway.

13. The dishwasher system of claim 12, wherein the given air inlet is aligned with the given outlet passageway coaxially.

14. The dishwasher system of claim 11, wherein the given outlet passageway is defined by an aspirator-type nozzle, a venturi tube or a nozzle with a knife-edge member.

15. The dishwasher system of claim 11, wherein the given outlet passageway has a diameter in a range from about 0.125 inches to about 0.375 inches.

16. The dishwasher system of claim 11, wherein the given air inlet has a diameter in a range from about 0.03 inches to about 0.1 inch.

17. The dishwasher system of claim 11, wherein the mixture of air and liquid is to be discharged from the given outlet passageway at a pressure of about 4 pounds per square inch (psi) and a flow rate in a range from about 0.65 gallons per minute (gpm) to about 0.85 gpm.

18. The dishwasher system of claim 17, wherein the mixture of air and liquid is to be discharged from the given outlet passageway and sprayed at a height in a range from about 8 inches to about 20 inches.

19. The dishwasher system of claim 11, wherein the mixture of air and liquid is to be discharged from the given outlet passageway at a pressure of about 7 pounds per square inch (psi) and a flow rate in a range from about 0.6 gallons per minute (gpm) to about 1.0 gpm.

20. The dishwasher system of claim 19, wherein the mixture of air and liquid is to be discharged from the given outlet passageway and sprayed to a height in a range from about 6 inches to about 28 inches.

* * * * *